United States Patent [19]

Martini et al.

[11] 4,336,155

[45] * Jun. 22, 1982

[54] MIXTURES OF OPTICAL BRIGHTENERS

[75] Inventors: Thomas Martini, Bad Soden am Taunus; Rüdiger Erckel, Eppstein; Horst Frühbeis, Kelkheim; Günter Rösch, Bad Soden am Taunus; Heinz Probst, Sulzbach, all of Fed. Rep. of Germany

[73] Assignee: Hoechst Aktiengesellschaft, Frankfurt, Fed. Rep. of Germany

[ * ] Notice: The portion of the term of this patent subsequent to May 18, 1999, has been disclaimed.

[21] Appl. No.: 169,873

[22] Filed: Jul. 16, 1980

[30] Foreign Application Priority Data

Jul. 21, 1979 [DE] Fed. Rep. of Germany ..... 2929591

[51] Int. Cl.[3] ..... C09K 11/06

[52] U.S. Cl. ..... 252/301.21; 252/301.22; 252/301.23; 252/301.24; 252/301.25; 252/301.26; 252/301.27; 252/301.28; 252/301.31; 252/301.32

[58] Field of Search ..... 252/301.21, 301.22, 252/301.23, 301.24, 301.25, 301.26, 301.27, 301.28, 301.31, 301.32

[56] References Cited

U.S. PATENT DOCUMENTS 3,669,896 6/1972 Preininger ..... 252/301.23

OTHER PUBLICATIONS

Yamauchi et al., Chem. Abst. 83 (1975) #61504c.

*Primary Examiner*—Arthur P. Demers
*Attorney, Agent, or Firm*—Connolly and Hutz

[57] ABSTRACT

Mixtures of optical brighteners consisting of 5 to 95% by weight of a compound of the formula in which A denotes a o- or p-cyanophenyl group, and 95 to 5% by weight of one or more further optical brighteners.

5 Claims, No Drawings

MIXTURES OF OPTICAL BRIGHTENERS

Mixtures of optical brighteners from the series of the 1,4-bis-(cyanostyryl)-benzenes and of the 4-alkoxynaphthalimides have already been disclosed in Japanese Patent Application Sho No. 50(1975)-25 877.

The present invention relates to mixtures of optical brighteners which have improved properties and consist of 0.05–0.95 parts by weight of a compound of the formula 1

(1)

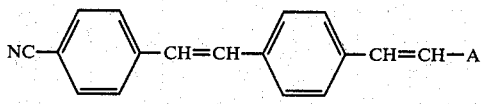

in which A denotes a o- or p-cyanophenyl group, and 0.95 to 0.05 parts by weight of one or more compounds of the formulae 2, 3, 4, 5 or 6

(2)

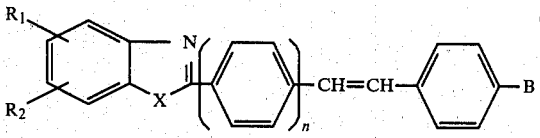

(3)

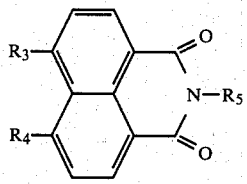

(4)

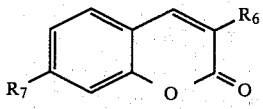

(5)

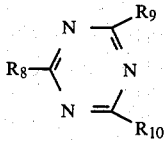

and (6)

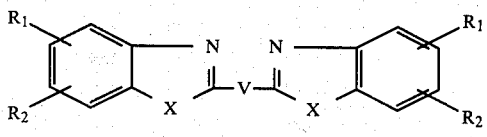

in which n denotes 0 or 1, X denotes an oxygen or sulfur atom, $R_1$ and $R_2$ denote identical or different radicals from the group comprising hydrogen, fluorine or chlorine atoms, phenyl, trifluoromethyl, $C_1$–$C_9$alkyl, alkoxy, dialkylamino, acylamino, cyano, carboxyl, carbalkoxy, carboxamide, sulfonic acid, sulfonamide or sulfonic acid alkyl ester, it being possible for two adjacent radicals $R_1$ and $R_2$ together also to represent a benzo ring, a lower alkylene group or a 1,3-dioxapropylene group, B denotes cyano, a group of the formula —$COOR_{11}$ or $CONR_{11}R_{11}$ in which $R_{11}$ denotes hydrogen, $C_1$–$C_{18}$alkyl, cycloalkyl, aryl, alkylaryl, halogenoaryl, aralkyl, alkoxyalkyl, halogenoalkyl, hydroxyalkyl, alkylaminoalkyl, carboxyalkyl or carboalkoxyalkyl, or two alkyl or alkylene radicals with the meaning of $R_{11}$ can also form, together with the nitrogen atom, a morpholine, piperidine or piperazine ring, or B denotes a group of the formula

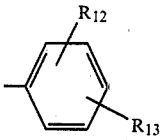

in which $R_{12}$ and $R_{13}$ denote identical or different radicals from the group comprising hydrogen, fluorine or chlorine atoms, phenyl, alkyl, alkoxy, acylamino, cyano, carboxyl, carbalkoxy, carboxamide, sulfonic acid, sulfonamide or sulfonic acid alkyl ester, it being possible for two adjacent radicals $R_{12}$ and $R_{13}$ together also to represent an alkylene group, a fused benzo ring or a 1,3-dioxapropylene group, or B denotes a group of the formulae

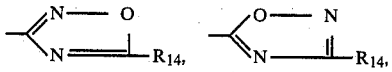

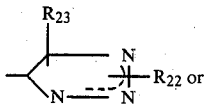

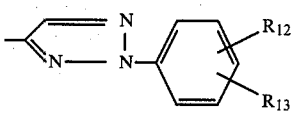

in which $R_{14}$ denotes a straight-chain or branched alkyl group having 1–18 C atoms and preferably 1–6 C atoms, which can be substituted by hydroxyl groups, halogen atoms or alkoxy, dialkylamino, alkylmercapto, chloroaryloxy, aryloxy, arylmercapto or aryl radicals, it being possible in the case of the dialkylamino alkyl groups for the two alkyl groups together also to form a morpholine, piperidine or piperazine ring, or $R_{14}$ denotes a group of the formula —$(CH_2CH_2O)_n$—R, in which n is 1, 2 or 3 and R is H, alkyl, dialkylaminoalkoxyalkyl or alkylthioalkoxyalkyl, it being possible for the dialkyl groups in dialkylaminoalkoxyalkyl together to form a piperidine, pyrrolidine, hexamethyleneimine, morpholine or piperazine ring, or $R_{14}$ denotes a radical of the formula

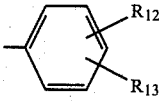

$R_{22}$ denotes a hydrogen atom, a triphenylmethyl group or a lower alkyl radical, which is optionally substituted by a lower carbalkoxy, carboxamido, mono- or di-alkylcarboxamido, carboxyl or benzoyl group, and $R_{23}$ denotes a cyano group or a group of the formulae

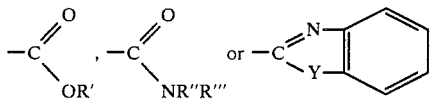

in which R′, R″ and R‴ denote a hydrogen atom, a lower alkyl radical or a phenyl radical, and it being possible for the lower alkyl radicals to be substituted by hydroxyl, lower alkoxy, lower dialkylamino or lower trialkylammonium groups and for the phenyl group to be substituted by halogen atoms or lower alkyl or lower alkoxy groups, and in which R″ and R‴ together can also form a saturated divalent radical, Y denotes O, S or N—R, in which R is H or ($C_1$ to $C_4$)-alkyl, or B denotes a group of the formula

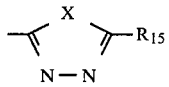

in which $R_{15}$ denotes a phenyl ring, which can be substituted by one or two chlorine atoms, one or two alkyl or alkoxyalkyl groups or one phenyl, cyano, carboxyl, carbalkoxy, carboxamide, sulfonic acid, sulfonamide or sulfonic acid alkyl ester group, $R_3$ and $R_4$ can be identical or different and denote hydrogen, alkyl, cycloalkyl, alkoxy, hydroxyalkoxyethyl, halogenoalkyl, aralkyl, aryl or N,N-di-alkylamine, or $R_3$ and $R_4$ together form a five-membered heterocyclic radical having 1 to 3 hetero-atoms, preferably N atoms, $R_5$ denotes straight-chain or branched alkyl, alkoxyalkyl, dialkylaminoalkyl or a radical of the formula

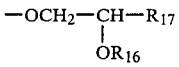

in which $R_{16}$ is hydrogen, $C_2$–$C_8$-alkanoyl, benzoyl or a radical of the formula $R_{18}NHCO$— or $R_{19}OCO$— and $R_{17}$ is hydrogen, alkyl or phenyl, $R_{18}$ is alkyl, phenyl, halogenophenyl or tolyl and $R_{19}$ is $C_1$–$C_8$-alkyl, alkoxyalkyl, cyclohexyl, benzyl, phenylethyl or phenyl which is optionally substituted by non-chromophoric substituents, or $R_5$ denotes a radical of the formula

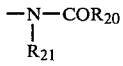

in which $R_{20}$ is $C_1$–$C_{10}$-alkyl, $C_2$–$C_6$-alkenyl, $C_2$–$C_6$-alkinyl, $C_1$–$C_8$-alkoxy, $C_1$–$C_8$-alkylamino or dialkylamino, phenoxymethyl, phenyl, tolyl, benzyl or phenylethyl and $R_{21}$ is $C_3$–$C_{10}$-alkyl, which can be substituted by phenyl, hydroxyphenyl, methoxy or dimethoxy, $R_6$ denotes an aryl radical, which is optionally substituted by non-chromophoric substituents, or denotes a 1,2,4-triazol-1-yl-phenyl, 1,2,3-triazol-4-yl-phenyl, 1,2,3-triazol-3-yl-phenyl or 1,2,3-triazol-2-yl-phenyl radical, which can optionally be substituted by 1 or 2 $C_1$–$C_3$-alkyl or oxalkyl groups or by oxaryl, oxalkenyl or oxalkanoyl, or $R_6$ denotes a heterocyclic ring having 1–3 hetero-atoms, preferably N or O, which can be substituted by alkyl, alkoxy, halogen, aryl or halogenoaryl, or $R_6$ denotes a 1-oxa-2,4-diazol-5-yl radical, which can be substituted by benzyl, alkoxyphenyl, styryl, halogen, alkoxy or a further heterocyclic group, or $R_6$ denotes a benzimidazol-1-yl, benzimidazol-2-yl, benzthiazol-1-yl or benzthiazol-2-yl radical, which can be substituted by non-chromophoric substituents, $R_7$ denotes hydrogen, alkyl, alkoxy, aryl or a five-membered heterocyclic radical which has 1–3 N or O hetero-atoms and is bonded via a nitrogen atom and can be substituted by alkyl, aryl, hydroxyl, oxalkyl, oxalkenyl, oxaryl, oxarylalkyl, oxalkoxycarbonyl, oxcarbamoyl, oxepoxyalkyl, styryl or halogenostyryl, a fused phenyl, naphthyl or phenanthryl ring or a fused group of the formulae

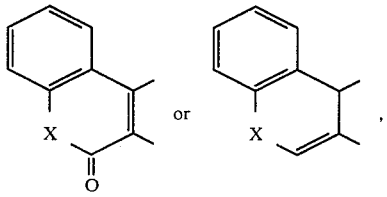

and the aromatic rings in the fused groups can also be substituted by alkyl or alkoxy and X is oxygen, NH or N-alkyl, $R_8$ represents a polycyclic, aromatic radical having at least three fused rings, which optionally carry non-chromophoric substituents, $R_9$ represents an amino group, which is substituted by one or two alkyl, hydroxyalkyl, acyl or phenyl groups, it being possible for the phenyl group to contain one or more non-chromophoric radicals and for two alkyl groups, together with the nitrogen atom of the amino group, to form a pyrrolidine or piperidine ring or, with the inclusion of a further nitrogen or oxygen atom, a piperazine or morpholine ring, or $R_9$ represents an alkoxy, hydroxyalkoxy, acyloxy, alkylthio or carbalkylmercapto group, $R_{10}$ independently of $R_8$ has the same meaning as $R_9$ and in addition can denote a chlorine atom and V denotes a group of the formulae

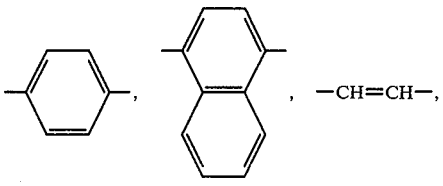

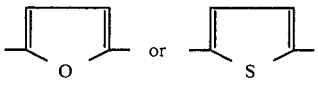

Preferred compounds of the formula 1 are those in which A represents a p-cyanophenyl group.

Unless defined otherwise, alkyl and alkoxy groups and also other groups derived therefrom contain 1 to 4 C atoms. The term "non-chromophoric substituents" is to be understood as meaning alkyl, alkoxy, aryl, aralkyl, trifluoromethyl, cycloalkyl, halogen, alkylsulfonyl, carboxyl, sulfonic acid, cyano, carboxamide, sulfonamide, carboxylic acid alkyl ester and sulfonic acid alkyl ester.

Of the compounds under the formulae 2 to 6, the compounds of the following formulae are preferred in the mixtures according to the invention:

Formula 2:

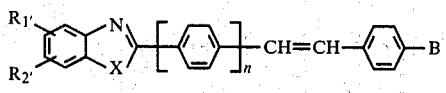

in which $R_{1'}$ and $R_{2'}$ in the 5-position and 7-position denote hydrogen or chlorine, alkyl or phenyl, or together denote a fused phenyl ring, X denotes oxygen or sulfur, n denotes 1 and B denotes a group of the formulae

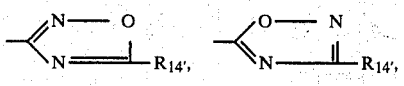

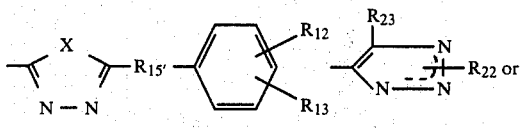

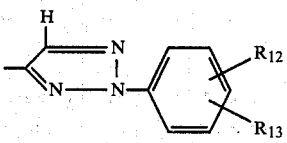

in which $R_{14'}$ denotes alkyl, chloroalkyl, alkoxyalkyl, hydroxyalkyl or a group of the formula $-(CH_2CH_2O)_n-R$, in which n is 2 or 3 and R is hydrogen or alkyl, $R_{15'}$ denotes phenyl, which can be substituted by one or two chlorine atoms, one or two alkyl or alkoxyalkyl groups or one phenyl, cyano, carboxylic acid, carboalkoxy, carboxamide, sulfonic acid, sulfonamide or sulfonic acid alkyl ester group, $R_{23}$ denotes cyano or carboalkoxy and $R_{22}$ denotes alkyl.

Formula 3:

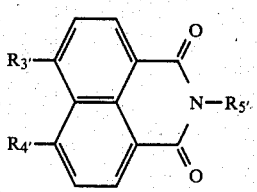

in which $R_{3'}$ denotes hydrogen or alkoxy, $R_{4'}$ denotes alkoxy and $R_{5'}$ denotes alkyl, alkoxyalkyl or dialkylaminoalkyl.

Formula 4:

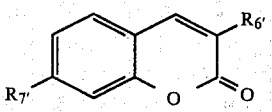

in which $R_{6'}$ denotes phenyl or the group of the formula

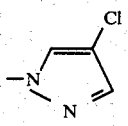

and $R_{7'}$ denotes the groups of the formulae

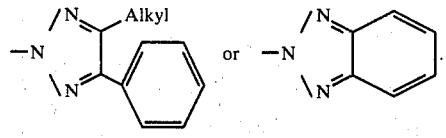

Formula 5:

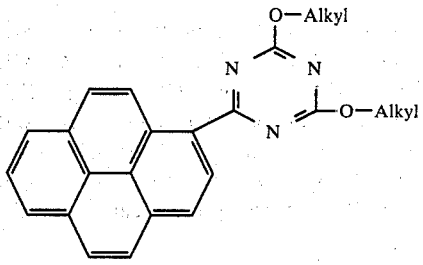

Formula 6:

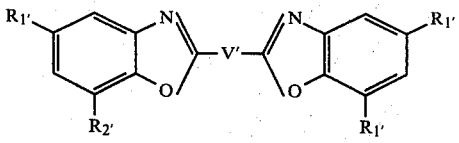

in which $R_{1'}$ and $R_{2'}$ denote hydrogen or alkyl and V' denotes a group of the formulae

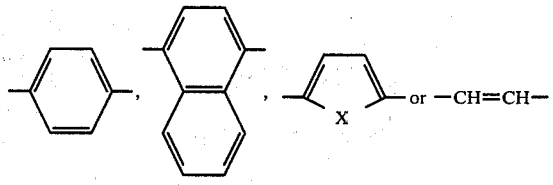

and X denotes O or S.

Further preferred mixtures, according to the invention, of optical brighteners are those consisting of a compound of the formula 1a (1a)

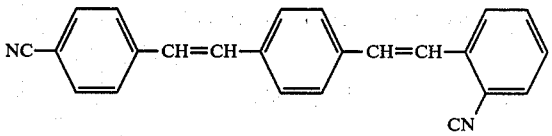

and one or more compounds of the formulae 2b–6b (2b)

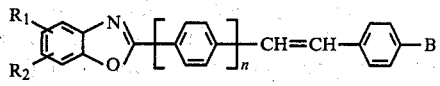

in which $R_1$ in the 5-position denotes a hydrogen or chlorine atom or a methyl or phenyl group and $R_2$ denotes a hydrogen atom, or $R_1$ and $R_2$ both denote a methyl group in the 5,6- or 5,7-position, n denotes 0 or 1 and B denotes a cyano or carbo-($C_1$–$C_4$)-alkoxy group or a group of the formulae

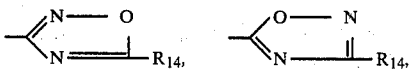

-continued

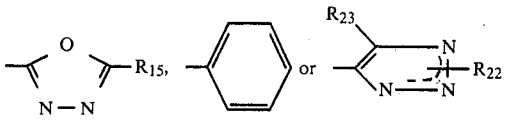

in which $R_{14}$ denotes ($C_1$–$C_6$)-alkyl, ($C_1$–$C_6$)-chloroalkyl, ($C_1$–$C_4$)-alkoxy-($C_1$–$C_4$)-alkyl, hydroxy-($C_1$–$C_4$)-alkyl or a group of the formula —$(CH_2CH_2O)_n$—R, n denotes 2 or 3 and R denotes hydrogen or ($C_1$–$C_4$)-alkyl, $R_{15}$ denotes phenyl, halogenophenyl, ($C_1$–$C_4$)-alkylphenyl or ($C_1$–$C_4$)-alkoxyphenyl, $R_{22}$ denotes ($C_1$–$C_4$)-alkyl and $R_{23}$ denotes cyano or carbo-($C_1$–$C_4$)-alkoxy, (3b)

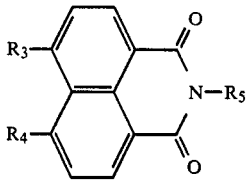

in which $R_3$ denotes hydrogen or ($C_1$–$C_4$)-alkoxy, $R_4$ denotes ($C_1$–$C_4$)-alkoxy and $R_5$ denotes ($C_1$–$C_6$)-alkyl or ($C_1$–$C_4$)-alkoxy-($C_1$–$C_4$)-alkyl, (4b)

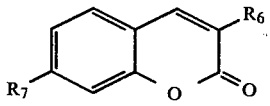

in which $R_6$ denotes phenyl or the group of the formulae

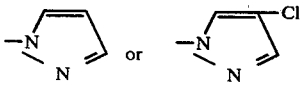

and $R_7$ denotes a group of the formula

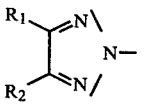

in which $R_1$ represents hydrogen or ($C_1$–$C_4$)-alkyl and $R_2$ represents phenyl or ($C_1$–$C_4$)-alkoxy, or $R_1$ and $R_2$ together represent a benzo or (1,2-d)-naphtho ring, (5b)

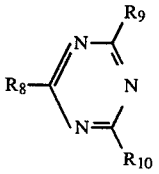

in which $R_8$ denotes the pyrenyl group and $R_9$ and $R_{10}$ denote ($C_1$–$C_4$)-alkoxy, and (6b)

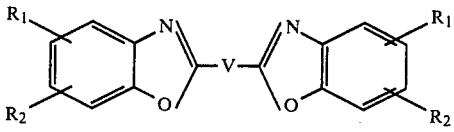

in which $R_1$ and $R_2$ have the same meaning as in formula 2b and V denotes a group of the formulae

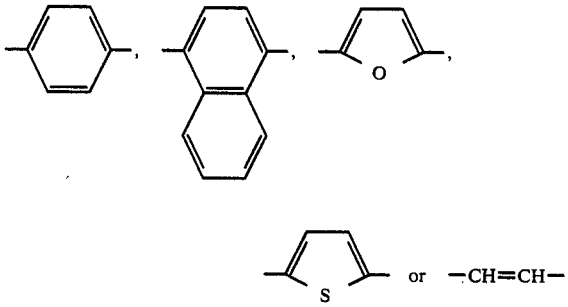

Further preferred mixtures of optical brighteners are those consisting of a compound of the formula 1a and one or more compounds of the following formulae (2c)

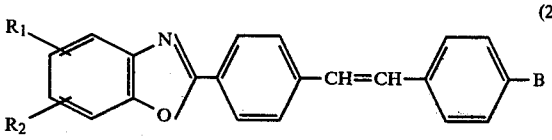

in which $R_1$ and $R_2$ in the 5,6-position are methyl and B is carbomethoxy, or $R_1$ is hydrogen, $R_2$ is hydrogen or methyl in the 5-position and B is carbomethoxy, cyano or a group of the formulae

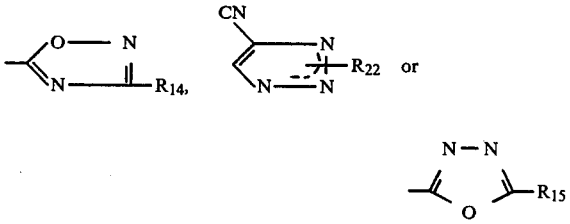

in which $R_{14}$ and $R_{22}$ are ($C_1$–$C_3$)-alkyl and $R_{15}$ is phenyl, 4-methylphenyl or 4-methoxyphenyl, or $R_1$ is hydrogen, methyl or t-butyl in the 5-position, $R_2$ is hydrogen or methyl in the 7-position and B is phenyl, (3c)

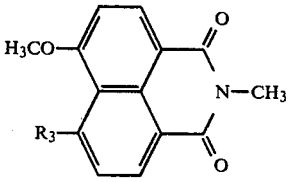

in which $R_3$ is hydrogen or methoxy,

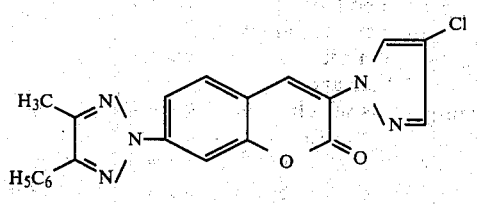

(4c)

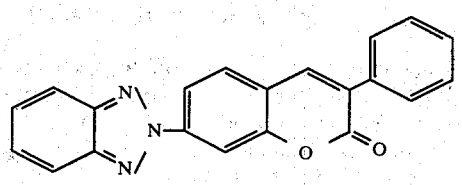

or

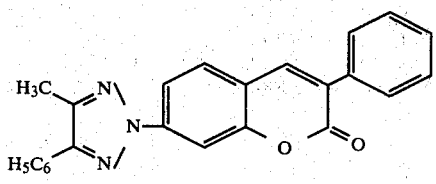

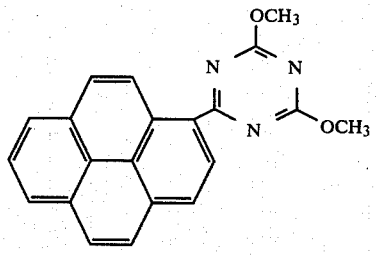

(5c)

and

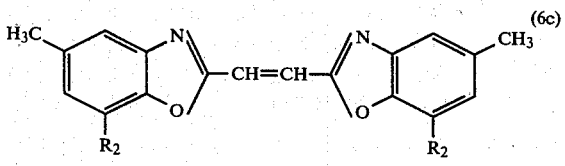

(6c)

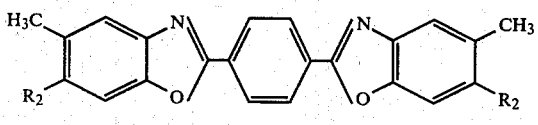

or

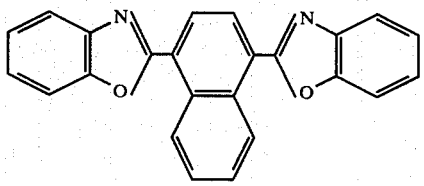

in which $R_2$ is hydrogen or methyl.

Of the compounds under the formula 2, those which are very particularly preferred are the compounds of the formula

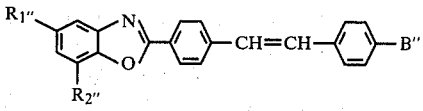

in which $R_{1''}$ and $R_{2''}$ denote hydrogen or alkyl and B'' denotes a group of the formulae

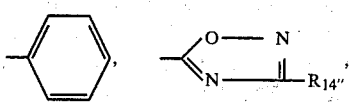

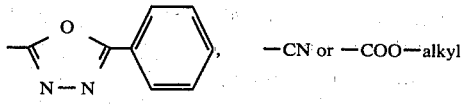

and $R_{14''}$ denotes alkyl or methoxyethyl. The following compounds under the formula 2:

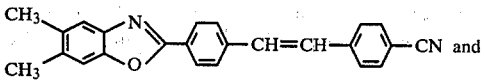

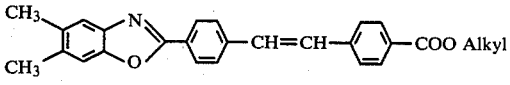

are of particular importance.

The mixing ratio for the individual components is between 0.05 and 0.95, preferably 0.20–0.80 parts by weight for the compounds of the formula 1 and correspondingly 0.95 to 0.05, preferably 0.80–0.20 parts by weight for the other compounds of the formulae 2 to 6. These compounds of the formulae 2 to 6 can be employed on their own, but can also be employed in any desired mixture with one another; the mixing ratio of these compounds with one another is entirely non-critical and can be varied as desired. The same applies in the case of the two brighteners which fall under formula 1 and which can be employed either on their own or as a mixture in any conceivable mixing ratio.

In an individual case, the optimum mixing ratio of all of the compounds of the formulae 1 to 6 depends on the structure of the particular compounds and can be determined without difficulty by simple preliminary experiments.

As is customary in the case of optical brighteners, the individual components are brought into the commercial form by dispersing in a liquid medium, for example water. The individual components can each be dispersed on their own and the dispersions can then be added together. However, it is also possible to mix the individual components with one another as the solids and then to disperse them together. This dispersion process is effected in a conventional manner in ball mills, colloid mills, bead mills or dispersion kneaders. The mixtures according to the invention are particularly suitable for brightening textile material made of linear polyesters, polyamides and acetylcellulose. However, these mixtures can also be used with a good result on mixed fabrics which consist of linear polyesters and other synthetic or natural fiber materials, specifically fibers containing hydroxyl groups and in particular cotton. These mixtures are applied under the conditions customary for the use of optical brighteners, thus, for example, by the exhaustion process at 90° C. to 130° C. with or without the addition of accelerators (carriers) or by the thermosol process. The brighteners which are insoluble in water and the mixtures according to the invention can also be used as a solution in organic solvents, for example perchloroethylene or fluorinated hydrocarbons. The textile material can be treated by the exhaustion process with the solvent liquor which contains the optical brighteners in solution, or the textile material is impregnated, padded or sprayed with the solvent liquor containing the brightener and then dried at temperatures of 120°–220° C., during which operation the optical brighteners are fixed without residue in the fiber. Outstandingly brightened goods are obtained which have excellent stability to light and also stability to oxidizing agents and reducing agents. Compared with the mixtures of Japanese Patent Sho No. 50(1975)-25 877, these mixtures according to the invention have higher whiteness and already give outstanding whiteness at low temperatures, for example 150° C.

The following tabulated examples illustrate the invention. The method of application employed is described here by way of example:

Cut pieces of a fabric made of polyester staple fibers are washed and dried and impregnated on a padder with aqueous dispersions which contain either the pure optical brightener of the formulae 1–6 in an amount of 0.08% by weight or a mixture of 0.064% by weight, 0.04% by weight and 0.016% by weight of the brightener of the formula 1 with 0.016, 0.04 and 0.064% by weight, respectively of the brighteners of the formula 2–6.

The material is now squeezed off between rollers using a padder, so that the resulting moisture absorption is about 80%. This corresponds to a pick-up of optical brighteners on the goods of 0.064%. The material padded in this way was then subjected to a thermosol treatment on a tenter frame for 30 seconds at 170° C. (Table I) or 210° (Table II). The Ganz whiteness indicated in each case was obtained, and these degrees of whiteness are higher than the whiteness of the mixtures of the brightener types 2–6 with 1,4-bis-(2′-cyanostyryl)-benzene. The whiteness was measured using a Type DMC-25 spectrophotometer (Messrs. Carl Zeiss, Oberkochen).

TABLE I
| Brightener 1 | Brightener 2–6 | Amount of brightener 1 used | Amount of brightener 2–6 used | Ganz whiteness |
|---|---|---|---|---|
| 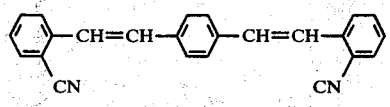 | — | 0.08 | | 206 |
| — | 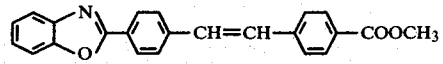 | — | 0.08 | 206 |
| " | " | 0.064 | 0.016 | 219 |
| " | " | 0.04 | 0.04 | 221 |
| " | " | 0.016 | 0.064 | 226 |
| 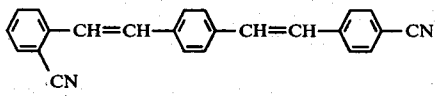 | — | 0.8 | — | 236 |
| " | " | 0.064 | 0.016 | 238 |
| " | " | 0.04 | 0.04 | 236 |
| " | " | 0.016 | 0.064 | 235 |
| — | 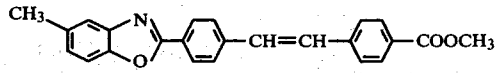 | — | 0.08 | 213 |
| 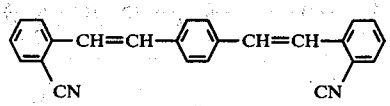 | 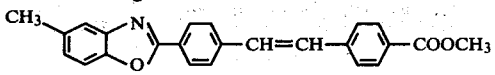 | 0.064 | 0.016 | 219 |
| " | " | 0.04 | 0.04 | 218 |
| " | " | 0.016 | 0.064 | 229 |
| 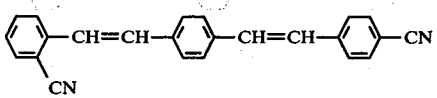 | 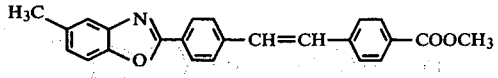 | 0.064 | 0.016 | 242 |
| 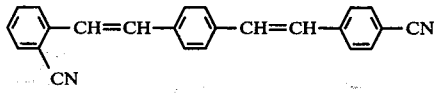 | 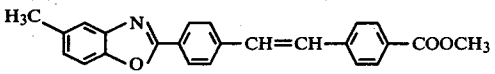 | 0.04 | 0.04 | 239 |
| " | " | 0.016 | 0.64 | 234 |
| — | 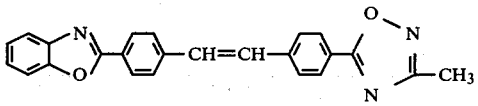 | — | 0.08 | 215 |
| 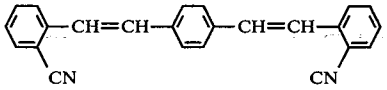 | 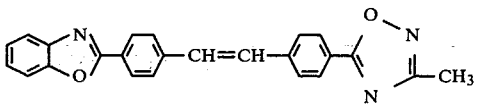 | 0.064 | 0.016 | 219 |

TABLE I-continued
| Brightener 1 | Brightener 2-6 | Amount of brightener 1 used | Amount of brightener 2-6 used | Ganz whiteness |
|---|---|---|---|---|
| " | " | 0.04 | 0.04 | 227 |
| " | | 0.016 | 0.064 | 225 |
| 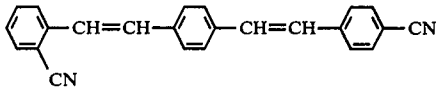 | " | 0.064 | 0.016 | 240 |
| " | " | 0.04 | 0.04 | 237 |
| " | " | 0.016 | 0.064 | 229 |
| — | 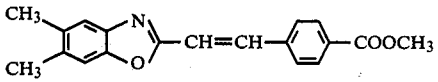 | — | 0.08 | 207 |
| 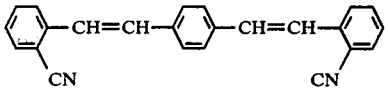 | " | 0.064 | 0.016 | 215 |
| " | " | 0.04 | 0.04 | 219 |
| 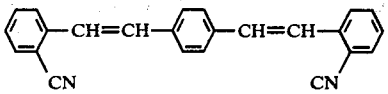 | 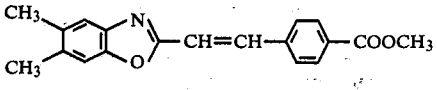 | 0.016 | 0.064 | 222 |
| 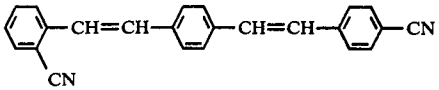 | " | 0.064 | 0.016 | 243 |
| " | " | 0.04 | 0.04 | 237 |
| " | " | 0.016 | 0.064 | 229 |
| — | 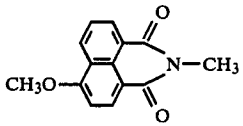 | — | 0.08 | 189 |
| 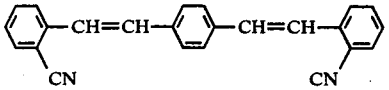 | " | 0.064 | 0.016 | 215 |
| " | " | 0.04 | 0.04 | 213 |
| " | " | 0.016 | 0.064 | 214 |
| 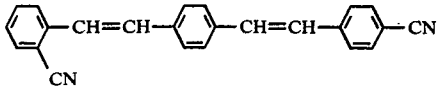 | " | 0.064 | 0.016 | 236 |
| " | " | 0.04 | 0.04 | 234 |
| " | " | 0.016 | 0.064 | 223 |

TABLE I-continued
| Brightener 1 | Brightener 2–6 | Amount of brightener 1 used | Amount of brightener 2–6 used | Ganz whiteness |
|---|---|---|---|---|
| 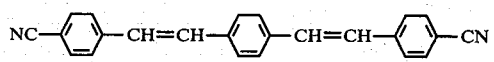 | 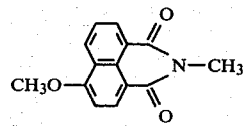 | 0.08 | — | 213 |
| " | " | 0.064 | 0.016 | 207 |
| " | " | 0.04 | 0.04 | 219 |
| " | " | 0.016 | 0.064 | 218 |
| — | 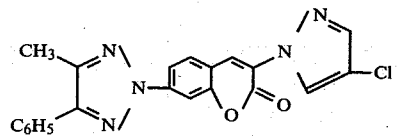 | — | 0.08 | 203 |
| 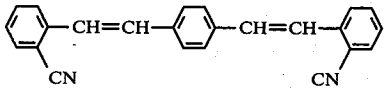 | | 0.064 | 0.016 | 203 |
| " | " | 0.04 | 0.04 | 205 |
| " | " | 0.016 | 0.064 | 200 |
| 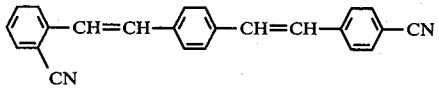 | " | 0.064 | 0.016 | 227 |
| " | " | 0.04 | 0.04 | 218 |
| " | " | 0.016 | 0.064 | 212 |
| — | 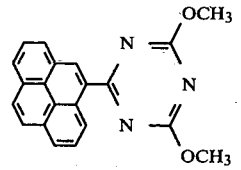 | — | 0.08 | 244 |
| 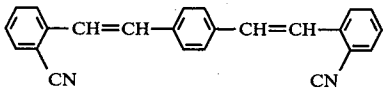 | " | 0.064 | 0.016 | 221 |
| " | " | 0.04 | 0.04 | 232 |

TABLE I-continued
| Brightener 1 | Brightener 2–6 | Amount of brightener 1 used | Amount of brightener 2–6 used | Ganz whiteness |
|---|---|---|---|---|
| 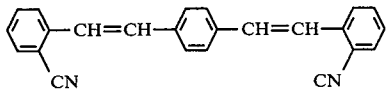 | 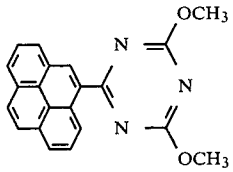 | 0.016 | 0.064 | 245 |
| 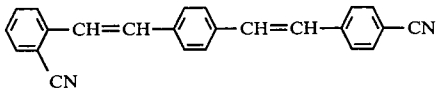 | " | 0.064 | 0.016 | 238 |
| " | " | 0.04 | 0.04 | 242 |
| " | " | 0.016 | 0.064 | 245 |

TABLE II
| Brightener 1 | Brightener 2–6 | Amount of brightener 1 used | Amount of brightener 2–6 used | Ganz whiteness |
|---|---|---|---|---|
| 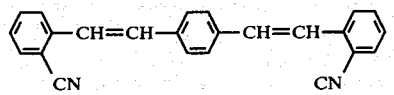 | — | 0.08 | | 235 |
| — | 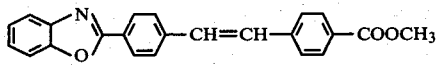 | — | 0.08 | 212 |
| " | " | 0.064 | 0.016 | 230 |
| " | " | 0.04 | 0.04 | 221 |
| " | " | 0.016 | 0.064 | 223 |
| 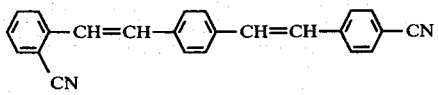 | — | 0.8 | — | 240 |
| " | " | 0.064 | 0.016 | 241 |
| " | " | 0.04 | 0.04 | 239 |
| " | " | 0.016 | 0.064 | 233 |
| — | 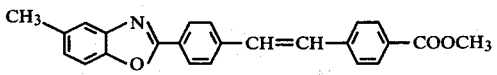 | — | 0.08 | 221 |
| 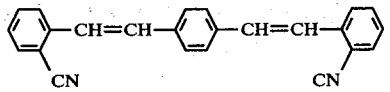 | 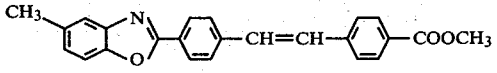 | 0.064 | 0.016 | 233 |
| " | " | 0.04 | 0.04 | 236 |
| " | " | 0.016 | 0.064 | 225 |
| 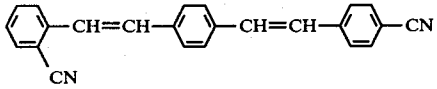 | 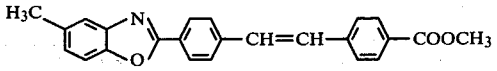 | 0.064 | 0.016 | 240 |
| 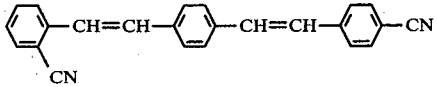 | 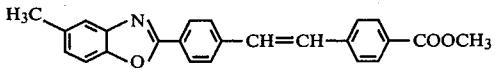 | 0.04 | 0.04 | 240 |
| " | " | 0.016 | 0.64 | 236 |
| — | 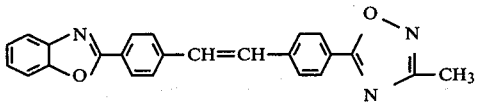 | — | 0.08 | 231 |
| 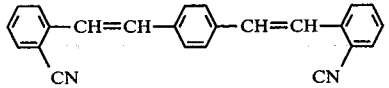 | 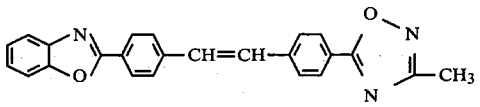 | 0.064 | 0.016 | 234 |

TABLE II-continued
| Brightener 1 | Brightener 2–6 | Amount of brightener 1 used | Amount of brightener 2–6 used | Ganz whiteness |
|---|---|---|---|---|
| " | " | 0.04 | 0.04 | 235 |
| " | " | 0.016 | 0.064 | 227 |
| 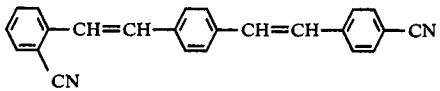 | " | 0.064 | 0.016 | 243 |
| " | " | 0.04 | 0.04 | 246 |
| " | " | 0.016 | 0.064 | 244 |
| — | 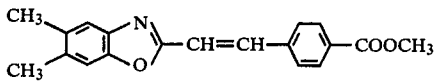 | — | 0.08 | 207 |
| 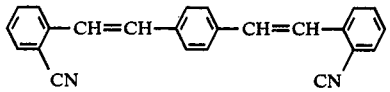 | " | 0.064 | 0.016 | 227 |
| " | " | 0.04 | 0.04 | 231 |
| 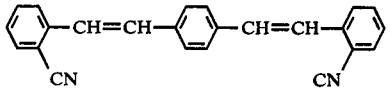 | 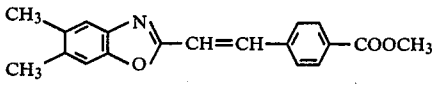 | 0.016 | 0.064 | 224 |
| 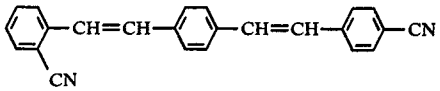 | " | 0.064 | 0.016 | 243 |
| " | " | 0.04 | 0.04 | 240 |
| " | " | 0.016 | 0.064 | 227 |
| — | 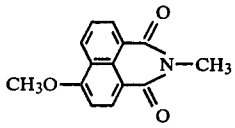 | — | 0.08 | 197 |
| 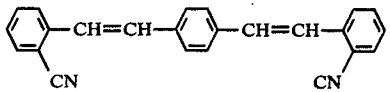 | " | 0.064 | 0.016 | 237 |
| " | " | 0.04 | 0.04 | 223 |
| " | " | 0.016 | 0.064 | 215 |
| 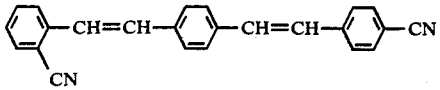 | " | 0.064 | 0.016 | 241 |
| " | " | 0.04 | 0.04 | 239 |
| " | " | 0.016 | 0.064 | 229 |

TABLE II-continued
| Brightener 1 | Brightener 2–6 | Amount of brightener 1 used | Amount of brightener 2–6 used | Ganz whiteness |
|---|---|---|---|---|
| 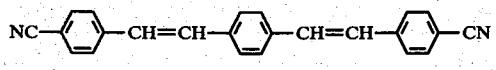 | 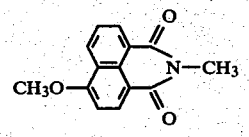 | 0.08 | — | 232 |
| " | " | 0.064 | 0.016 | 223 |
| " | " | 0.04 | 0.04 | 230 |
| " | " | 0.016 | 0.064 | 233 |
| — | 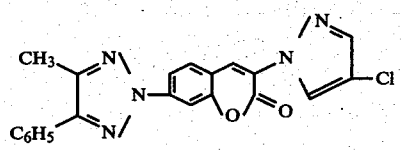 | — | 0.08 | 206 |
| 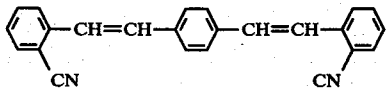 | | 0.064 | 0.016 | 233 |
| " | " | 0.04 | 0.04 | 228 |
| " | " | 0.016 | 0.064 | 227 |
| 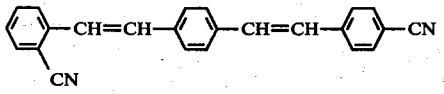 | " | 0.064 | 0.016 | 241 |
| " | " | 0.04 | 0.04 | 229 |
| " | " | 0.016 | 0.064 | 214 |
| — | 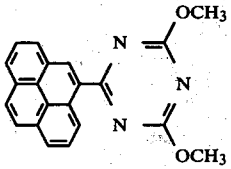 | — | 0.08 | 204 |
| 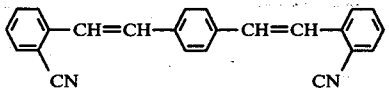 | " | 0.064 | 0.016 | 228 |
| " | " | 0.04 | 0.04 | 224 |

TABLE II-continued
| Brightener 1 | Brightener 2–6 | Amount of brightener 1 used | Amount of brightener 2–6 used | Ganz whiteness |
|---|---|---|---|---|
| 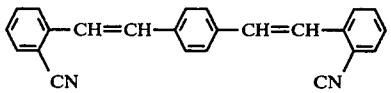 | 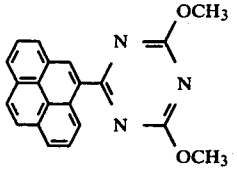 | 0.016 | 0.064 | 214 |
| 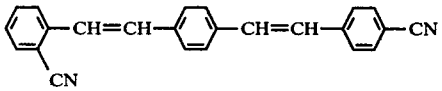 | " | 0.064 | 0.016 | 234 |
| " | " | 0.04 | 0.04 | 216 |
| " | " | 0.016 | 0.064 | 204 |

We claim:

1. Mixtures of optical brighteners consisting of 0.05–0.95 parts by weight of a compounds of the formula 1

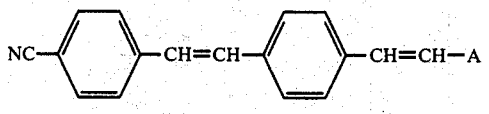

(1)

in which A denotes a o- or p-cyanophenyl group, and 0.95 to 0.05 parts by weight of one or more compounds of the formulae 2, 3, 4, 5 or 6

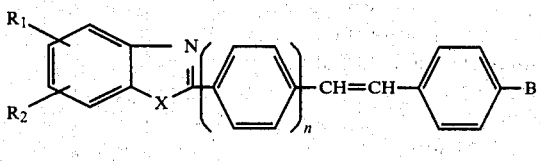

(2)

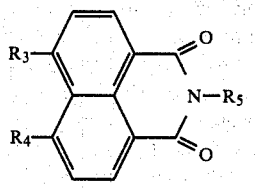

(3)

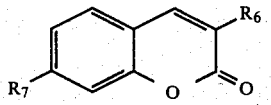

(4)

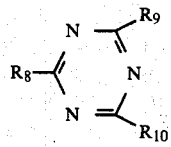

(5)

and

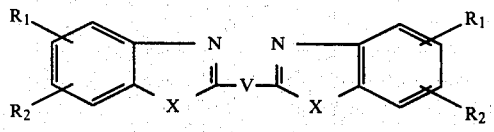

(6)

in which n denotes 0 or 1, X denotes an oxygen or sulfur atom, $R_1$ and $R_2$ denote identical or different radicals from the group comprising hydrogen, fluorine or chlorine atoms, phenyl, trifluoromethyl, $C_1$–$C_9$alkyl, alkoxy, dialkylamino, acylamino, cyano, carboxyl, carbalkoxy, carboxamide, sulfonic acid, sulfonamide or sulfonic acid alkyl ester, it being possible for two adjacent radicals $R_1$ and $R_2$ together also to represent a benzo ring, a lower alkylene group or a 1,3-dioxapropylene group, B denotes cyano, a group of the formula —$COOR_{11}$ or $CONR_{11}R_{11}$ in which $R_{11}$ denotes hydrogen, $C_1$–$C_{18}$alkyl, cycloalkyl, aryl, alkylaryl, halogenoaryl, aralkyl, alkoxyalkyl, halogenoalkyl, hydroxyalkyl, alkylamino-alkyl, carboxyalkyl or carboalkoxyalkyl, or two alkyl or alkylene radicals with the meaning of $R_{11}$ can also form, together with the nitrogen atom, a morpholine, piperidine or piperazine ring, or B denotes a group of the formula

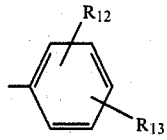

in which $R_{12}$ and $R_{13}$ denote identical or different radicals from the group comprising hydrogen, fluorine or chlorine atoms, phenyl, alkyl, alkoxy, acylamino, cyano, carboxyl, carbalkoxy, carboxamide, sulfonic acid, sulfonamide or sulfonic acid alkyl ester, it being possible for two adjacent radicals $R_{12}$ and $R_{13}$ together also to represent an alkylene group, a fused benzo ring or a 1,3-dioxapropylene group, or B denotes a group of the formulae

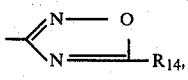

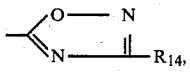

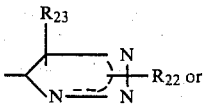

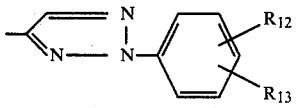

in which $R_{14}$ denotes a straight-chain or branched alkyl group having 1–18 C atoms and preferably 1–6 C atoms, which can be substituted by hydroxyl groups, halogen atoms or alkoxy, dialkylamino, alkylmercapto, chloroaryloxy, aryloxy, arylmercapto or aryl radicals, it being possible in the case of the dialkylamino alkyl groups for the two alkyl groups together also to form a morpholine, piperidine or piperazine ring, or $R_{14}$ denotes a group of the formula —$(CH_2CH_2O)_n$—R, in which n is 1, 2 or 3 and R is H, alkyl, dialkylaminoalkoxyalkyl or alkylthioalkoxyalkyl, it being possible for the dialkyl groups in dialkylaminoalkoxyalkyl together to form a piperidine, pyrrolidine, hexamethyleneimine, morpholine or piperazine ring, or $R_{14}$ denotes a radical of the formula

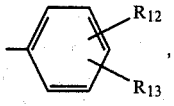

$R_{22}$ denotes a hydrogen atom, a triphenylmethyl group or a lower alkyl radical, which is optionally substituted by a lower carbalkoxy, carboxamido, mono- or di-alkylcarboxamido, carboxyl or benzoyl group, and $R_{23}$ denotes a cyano group or a group of the formulae

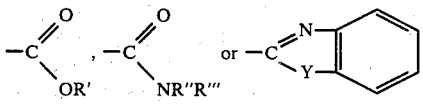

in which R′, R″ and R‴ denote a hydrogen atom, a lower alkyl radical or a phenyl radical, and it being possible for the lower alkyl radicals to be substituted by hydroxyl, lower alkoxy, lower dialkylamino or lower trialkylammonium groups and for the phenyl group to be substituted by halogen atoms or lower alkyl or lower alkoxy groups, and in which R'' and R''' together can also form a saturated divalent radical, Y denotes O, S or N–R, in which R is H or ($C_1$ to $C_4$)-alkyl, or B denotes a group of the formula

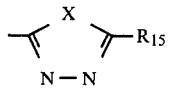

in which $R_{15}$ denotes a phenyl ring, which can be substituted by one or two chlorine atoms, one or two alkyl or alkoxyalkyl groups or one phenyl, cyano, carboxyl, carbalkoxy, carboxamide, sulfonic acid, sulfonamide or sulfonic acid alkyl ester group, $R_3$ and $R_4$ can be identical or different and denote hydrogen, alkyl, cycloalkyl, alkoxy, hydroxyalkoxyethyl, halogenoalkyl, aralkyl, aryl or N,N-di-alkylamine, or $R_3$ and $R_4$ together form a five-membered heterocyclic radical having 1 to 3 hetero-atoms, preferably N atoms, $R_5$ denotes straight-chain or branched alkyl, alkoxyalkyl, dialkylaminoalkyl or a radical of the formula

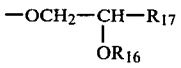

in which $R_{16}$ is hydrogen, $C_2$–$C_8$-alkanoyl, benzoyl or a radical of the formula $R_{18}NHCO$— or $R_{19}OCO$— and $R_{17}$ is hydrogen, alkyl or phenyl, $R_{18}$ is alkyl, phenyl, halogenophenyl or tolyl and $R_{19}$ is $C_1$–$C_8$-alkyl, alkoxyalkyl, cyclohexyl, benzyl, phenylethyl or phenyl which is optionally substituted by non-chromophoric substituents, or $R_5$ denotes a radical of the formula

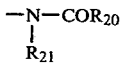

in which $R_{20}$ is $C_1$–$C_{10}$-alkyl, $C_2$–$C_6$-alkenyl, $C_2$–$C_6$-alkinyl, $C_1$–$C_8$-alkoxy, $C_1$–$C_8$-alkylamino or dialkylamino, phenoxymethyl, phenyl, tolyl, benzyl or phenylethyl and $R_{21}$ is $C_3$–$C_{10}$-alkyl, which can be substituted by phenyl, hydroxyphenyl, methoxy or dimethoxy, $R_6$ denotes an aryl radical, which is optionally substituted by non-chromophoric substituents, or denotes a 1,2,4-triazol-1-yl-phenyl, 1,2,3-triazol-4-yl-phenyl, 1,2,3-triazol-3-yl-phenyl or 1,2,3-triazol-2-yl-phenyl radical, which can optionally be substituted by 1 or 2 $C_1$–$C_3$-alkyl or oxalkyl groups or by oxaryl, oxalkenyl or oxalkanoyl, or $R_6$ denotes a heterocyclic ring having 1–3 hetero-atoms, preferably N or 0, which can be substituted by alkyl, alkoxy, halogen, aryl or halogenoaryl, or $R_6$ denotes a 1-oxa-2,4-diazol-5-yl radical, which can be substituted by benzyl, alkoxyphenyl, styryl, halogen, alkoxy or a further heterocyclic group, or $R_6$ denotes a benzimidazol-1-yl, benzimidazol-2-yl, benzthiazol-1-yl or benzthiazol-2-yl radical, which can be substituted by non-chromophoric substituents, $R_7$ denotes hydrogen, alkyl, alkoxy, aryl or a five-membered heterocyclic radical which has 1–3 N or 0 hetero-atoms and is bonded via a nitrogen atom and can be substituted by alkyl, aryl, hydroxyl, oxalkyl, oxalkenyl, oxaryl, oxarylalkyl, oxalkoxycarbonyl, oxcarbamoyl, oxepoxyalkyl, styryl or halogenostyryl, a fused phenyl, naphthyl or phenanthryl ring or a fused group of the formulae

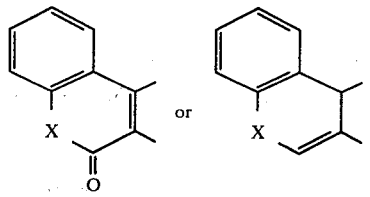

and the aromatic rings in the fused groups can also be substituted by alkyl or alkoxy and X is oxygen, NH or N-alkyl, $R_8$ represents a polycyclic, aromatic radical having at least three fused rings, which optionally carry non-chromophoric substituents, $R_9$ represents an amino group, which is substituted by one or two alkyl, hydroxyalkyl, acyl or phenyl groups, it being possible for the phenyl group to contain one or more non-chromophoric radicals and for two alkyl groups, together with the nitrogen atom of the amino group, to form a pyrrolidine or piperidine ring or, with the inclusion of a further nitrogen or oxygen atom, a piperazine or morpholine ring, or $R_9$ represents an alkoxy, hydroxyalkoxy, acyloxy, alkylthio or carbalkylmercapto group, $R_{10}$ independently of $R_8$ has the same meaning as $R_9$ and in addition can denote a chlorine atom and V denotes a group of the formulae

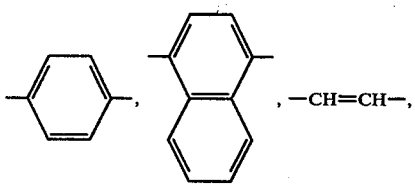

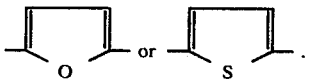

2. Mixtures of optical brighteners as claimed in claim 1, consisting of a compound of the formula

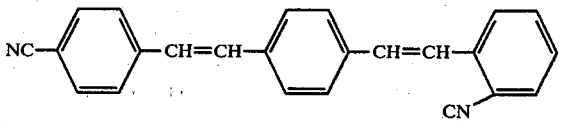

and one or more compounds of the formulae 2a–6a

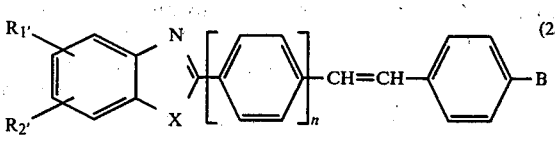

(2a)

in which $R_{1'}$ and $R_{2'}$ in the 5-position and 7-position denote hydrogen or chlorine, alkyl or phenyl, or together denote a fused phenyl ring, X denotes oxygen or sulfur, n denotes 1 and B denotes a group of the formulae

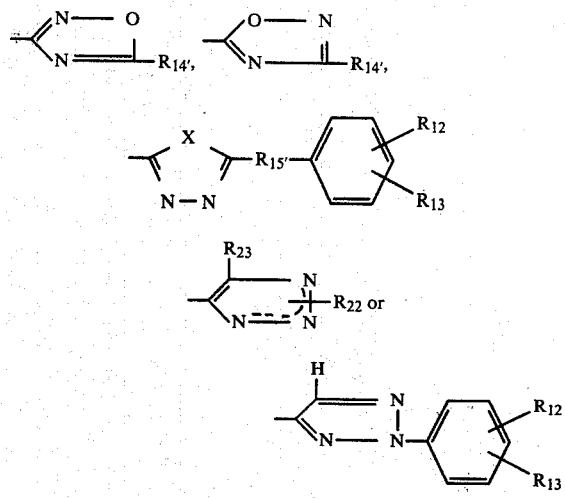

in which $R_{14'}$ denotes alkyl, chloroalkyl, alkoxyalkyl, hydroxyalkyl or a group of the formula $-(CH_2CH_2O)_n-R$, in which n is 2 or 3 and R is hydrogen or alkyl, $R_{15'}$ denotes phenyl, which can be substituted by one or two chlorine atoms, one or two alkyl or alkoxyalkyl groups or one phenyl, cyano, carboxylic acid, carboalkoxy, carboxamide, sulfonic acid, sulfonamide or sulfonic acid alkyl ester group, $R_{23}$ denotes cyano or carboalkoxy and $R_{22}$ denotes alkyl,

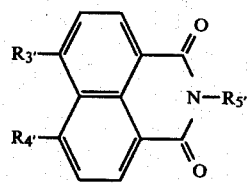

(3a)

in which $R_{3'}$ denotes hydrogen or alkoxy, $R_{4'}$ denotes alkoxy and $R_{5'}$ denotes alkyl, alkoxyalkyl or dialkylaminoalkyl,

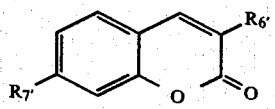

(4a)

in which $R_{6'}$ denotes phenyl or the group of the formula

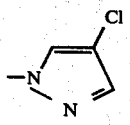

and $R_{7'}$ denotes the groups of the formulae

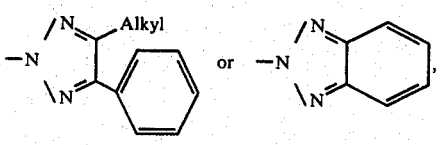

-continued

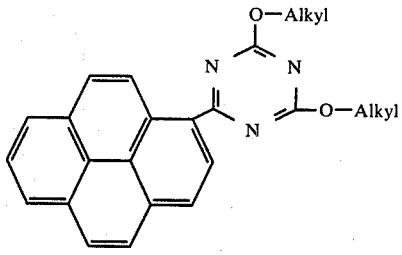

(5a)

and

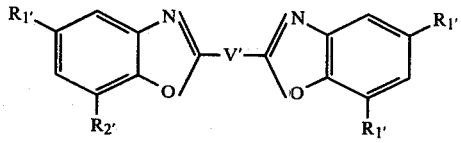

(6a)

in which $R_{1'}$ and $R_{2'}$ denote hydrogen or alkyl and V' denotes a group of the formulae

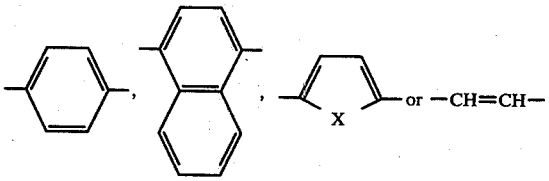

and X denotes 0 or S.

3. Mixtures of optical brighteners as claimed in claim 1, consisting of a compound of the formula 1a

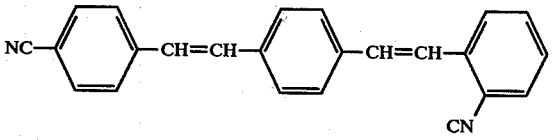

(1a)

and one or more compounds of the formulae 2b–6b

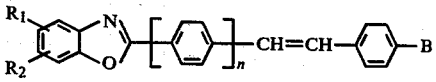

(2b)

in which $R_1$ in the 5-position denotes a hydrogen or chlorine atom or a methyl or phenyl group and $R_2$ denotes a hydrogen atom, or $R_1$ and $R_2$ both denote a methyl group in the 5,6- or 5,7-position, n denotes 0 or 1 and B denotes a cyano or carbo-($C_1$–$C_4$)-alkoxy group or a group of the formulae

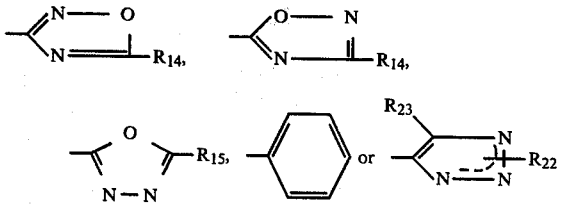

in which $R_{14}$ denotes ($C_1$–$C_6$)-alkyl, ($C_1$–$C_6$)-chloroalkyl, ($C_1$–$C_4$)-alkoxy-($C_1$–$C_4$)-alkyl, hydroxy-($C_1$–$C_4$)- alkyl or a group of the formula $-(CH_2CH_2O)_n-R$, n denotes 2 or 3 and R denotes hydrogen or $(C_1-C_4)$-alkyl, $R_{15}$ denotes phenyl, halogenophenyl, $(C_1-C_4)$-alkylphenyl or $(C_1-C_4)$-alkoxyphenyl, $R_{22}$ denotes $(C_1-C_4)$-alkyl and $R_{23}$ denotes cyano or carbo-$(C_1-C_4)$-alkoxy, (3b)

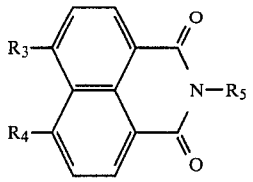

in which $R_3$ denotes hydrogen or $(C_1-C_4)$-alkoxy, $R_4$ denotes $(C_1-C_4)$-alkoxy and $R_5$ denotes $(C_1-C_6)$-alkyl or $(C_1-C_4)$-alkoxy-$(C_1-C_4)$-alkyl, (4b)

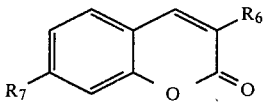

in which $R_6$ denotes phenyl or the group of the formulae

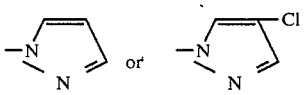

and $R_7$ denotes a group of the formula

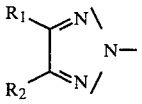

in which $R_1$ represents hydrogen or $(C_1-C_4)$-alkyl and $R_2$ represents phenyl or $(C_1-C_4)$-alkoxy, or $R_1$ and $R_2$ together represent a benzo or (1,2-d)-naphtho ring, (5b)

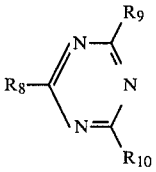

in which $R_8$ denotes the pyrenyl group and $R_9$ and $R_{10}$ denote $(C_1-C_4)$-alkoxy, and (6b)

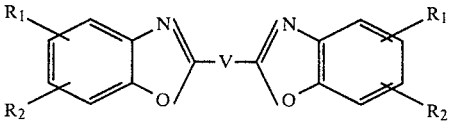

in which $R_1$ and $R_2$ have the same meaning as in formula 2b and V denotes a group of the formulae

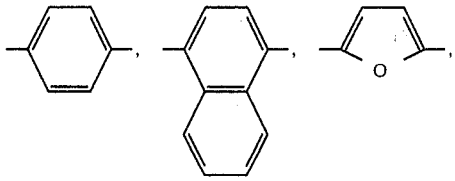

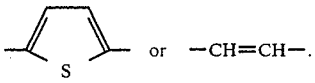

4. Mixtures of optical brighteners as claimed in claim 1, consisting of a compound of the formula 1a and one or more compounds of the following formulae (2c)

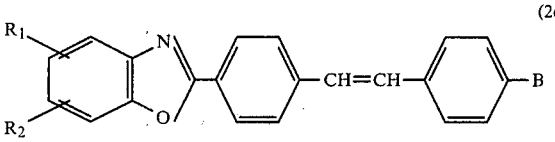

in which $R_1$ and $R_2$ in the 5,6-position are methyl and B is carbomethoxy, or $R_1$ is hydrogen, $R_2$ is hydrogen or methyl in the 5-position and B is carbomethoxy, cyano or a group of the formulae

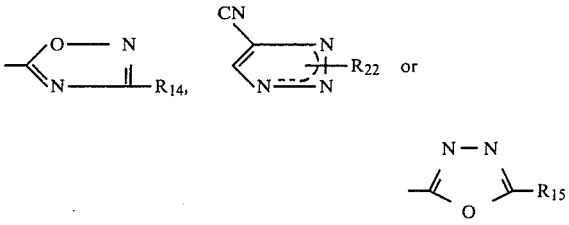

in which $R_{14}$ and $R_{22}$ are $(C_1-C_3)$-alkyl and $R_{15}$ is phenyl, 4-methylphenyl or 4-methoxyphenyl, or $R_1$ is hydrogen, methyl or t-butyl in the 5-position, $R_2$ is hydrogen or methyl in the 7-position and B is phenyl, (3c)

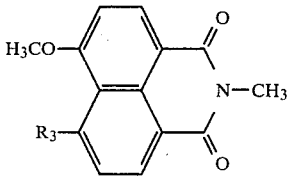

in which $R_3$ is hydrogen or methoxy, (4c)

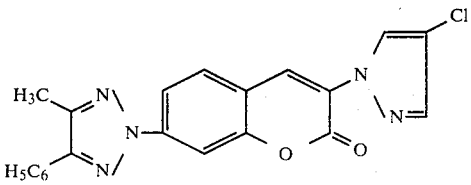

-continued
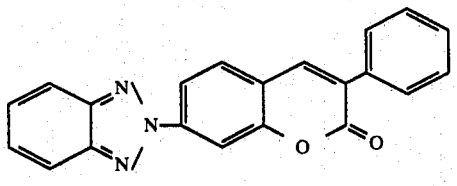
or
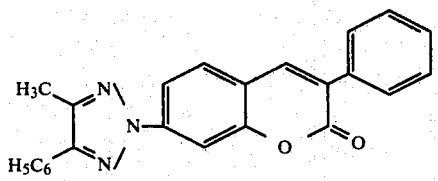
(5c)
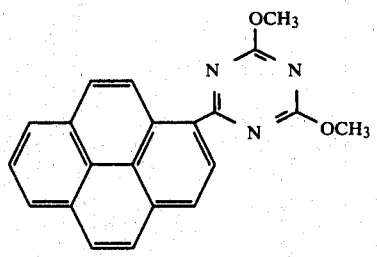
-continued
and
(6c)
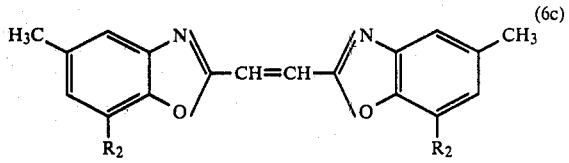
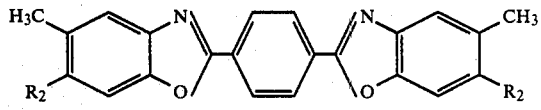
or
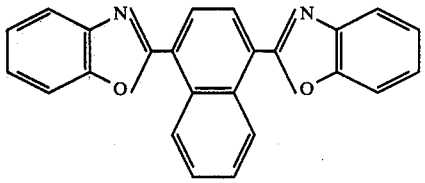
in which $R_2$ is hydrogen or methyl.
5. Mixtures of optical brighteners as claimed in claims 1 to 4, consisting of 20 to 80% by weight of a compound of the formula 1 and 80 to 20% by weight of one or more compounds of the formulae 2 to 6.
* * * * *